US011220980B2

(12) United States Patent
Nair et al.

(10) Patent No.: US 11,220,980 B2
(45) Date of Patent: Jan. 11, 2022

(54) FUEL SYSTEM HAVING ISOLATION VALVES BETWEEN FUEL INJECTORS AND COMMON DRAIN CONDUIT

(71) Applicant: Caterpillar Inc., Deerfield, IL (US)

(72) Inventors: Siddharth Nair, Dunlap, IL (US); Manjunath Bannur Nagaraja, Naperville, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 16/414,522

(22) Filed: May 16, 2019

(65) Prior Publication Data

US 2020/0362797 A1 Nov. 19, 2020

(51) Int. Cl.

| | |
|---|---|
| ***F02M 21/02*** | (2006.01) |
| ***F02M 55/00*** | (2006.01) |
| ***F02M 63/00*** | (2006.01) |
| ***F02M 63/02*** | (2006.01) |
| ***F02M 47/02*** | (2006.01) |

(52) U.S. Cl.

CPC ..... *F02M 21/0251* (2013.01); *F02M 21/026* (2013.01); *F02M 47/027* (2013.01); *F02M 55/007* (2013.01); *F02M 63/0054* (2013.01); *F02M 63/0215* (2013.01)

(58) Field of Classification Search

CPC ..... F02M 2200/04; F02M 2200/28; F02M 2200/31; F02M 2200/315; F02M 47/027; F02M 57/02; F02M 57/025; F02M 57/026; F02M 63/0015; F02M 63/0054; F02M 63/0225

See application file for complete search history.

(56) References Cited

U.S. PATENT DOCUMENTS

| | | | | | |
|---|---|---|---|---|---|
| 1,329,559 | A | | 2/1920 | Tesla | |
| 1,974,851 | A | * | 9/1934 | Hurst | A41B 3/08 123/459 |
| 2,612,841 | A | * | 10/1952 | Lasley | F02M 59/462 417/501 |
| 2,918,048 | A | * | 12/1959 | Aldinger | F02M 59/36 123/459 |
| 2,960,998 | A | * | 11/1960 | Sinker | F16K 15/063 137/542 |

(Continued)

FOREIGN PATENT DOCUMENTS

| | | | | |
|---|---|---|---|---|
| DE | 102006054065 A1 | * | 5/2008 | F02M 47/027 |
| DE | 102007010497 A1 | * | 9/2008 | F02M 63/004 |

(Continued)

*Primary Examiner* — John M Zaleskas

(74) *Attorney, Agent, or Firm* — Brannon Sowers & Cracraft

(57) ABSTRACT

A fuel system includes a plurality of fuel injectors connected to a common drain conduit, and a plurality of isolation valve assemblies each positioned fluidly between the common drain conduit and one of the plurality of fuel injectors. Each isolation valve assembly includes a valve member movable between a closed position to block an injection control valve assembly in the fuel injector from the common drain conduit, and an open position, and a biaser biasing the isolation valve member toward the closed position such that fuel injectors are isolated from fluid pressure pulses produced by nozzle check actuation to limit cross-talk among the fuel injectors.

16 Claims, 4 Drawing Sheets

(56) References Cited

U.S. PATENT DOCUMENTS 3,559,678 A * 2/1971 Donner ..... F16K 15/044 137/535
3,625,192 A * 12/1971 Dreisin ..... F02M 41/12 123/495
3,695,784 A * 10/1972 Tateishi ..... F02M 59/462 417/296
3,774,504 A * 11/1973 Bonney ..... F15B 13/04 91/446
4,378,775 A * 4/1983 Straubel ..... F02M 59/366 123/446
4,396,151 A * 8/1983 Kato ..... F02M 57/024 123/446
4,448,169 A * 5/1984 Badgley ..... F02M 59/105 123/467
4,628,881 A 12/1986 Beck et al.
4,848,658 A * 7/1989 Aketa ..... F02M 47/02 239/88
4,948,049 A 8/1990 Brisbon et al.
5,007,584 A * 4/1991 Rossignol ..... F02M 57/023 239/88
5,121,730 A * 6/1992 Ausman ..... F02M 57/025 123/381
5,168,855 A * 12/1992 Stone ..... F02M 55/00 123/446
5,176,115 A * 1/1993 Campion ..... F02M 57/025 123/179.17
5,181,494 A * 1/1993 Ausman ..... F02M 57/025 123/179.17
5,235,954 A 8/1993 Sverdlin
5,669,334 A * 9/1997 Schonfeld ..... F02M 43/04 123/25 C
6,622,701 B2 9/2003 Endo
7,278,593 B2 10/2007 Wang et al.
9,638,422 B2 5/2017 Hall et al.
2004/0050367 A1* 3/2004 Kurrle ..... F02M 61/205 123/472
2004/0056117 A1* 3/2004 Wang ..... F02M 61/205 239/533.2
2005/0045150 A1* 3/2005 Furukubo ..... F02M 47/027 123/447
2005/0242211 A1* 11/2005 Funai ..... F02M 63/0054 239/533.2
2005/0274828 A1* 12/2005 Kurz ..... F02M 61/205 239/533.2
2006/0162695 A1* 7/2006 Shibata ..... F02M 57/025 123/446
2006/0231076 A1* 10/2006 Magel ..... F02M 57/023 123/446
2008/0156905 A1* 7/2008 Shafer ..... F02M 47/027 239/585.1
2010/0037862 A1* 2/2010 Millet ..... F02M 45/12 123/447
2011/0248103 A1* 10/2011 Shafer ..... F02M 63/0015 239/585.1
2011/0297125 A1 12/2011 Shafer et al.
2012/0305675 A1* 12/2012 Eisenmenger ..... F02M 63/0026 239/533.2
2013/0153686 A1* 6/2013 Keeler ..... F02M 47/027 239/584
2014/0252108 A1* 9/2014 Cavanagh ..... F02M 63/0054 239/5
2014/0252109 A1* 9/2014 Cavanagh ..... F02M 61/12 239/5
2016/0115928 A1* 4/2016 Cavanagh ..... F02M 63/0005 123/456
2016/0341166 A1* 11/2016 Martin ..... F02M 61/04
2020/0362805 A1* 11/2020 Nair ..... F02M 69/145

FOREIGN PATENT DOCUMENTS

EP 1655477 A1 * 5/2006 ..... F02M 63/0031
EP 3112700 B1 3/2018
GB 2269426 A * 2/1994 ..... F02M 59/485
JP 11022584 A * 1/1999
JP 11270431 A * 10/1999
JP 2006161716 A * 6/2006 ..... F02M 47/027
JP 2008045539 A * 2/2008 ..... F02M 47/027
JP 2009209717 A * 9/2009 ..... F02M 63/004
WO 2015122537 A1 8/2015

* cited by examiner

FUEL SYSTEM HAVING ISOLATION VALVES BETWEEN FUEL INJECTORS AND COMMON DRAIN CONDUIT

TECHNICAL FIELD

The present disclosure relates generally to a fuel system for an internal combustion engine, and more particularly to positioning an isolation valve assembly between each of a plurality of fuel injectors in a fuel system and a common drain conduit.

BACKGROUND

Internal combustion engines are well known and widely used in applications ranging from electrical power generation to providing torque for machinery propulsion, and powering pumps, compressors, and other equipment. In some internal combustion engines, such as compression ignition diesel engines, the subsystem for providing fuel is complex and has many rapidly moving parts, high fluid pressures, and otherwise harsh conditions. Service life of such fuel systems is typically desired to be in the tens of thousands of hours. In a typical fuel system for a compression ignition diesel engine, a plurality of fuel injectors are each associated with one of a plurality of cylinders and extend into the individual cylinders to directly inject metered amounts of pressurized fuel. Individual fuel injectors may be equipped with so-called unit pumps having a fuel pressurization plunger driven by an engine cam or hydraulic fluid, for example. In other systems a common reservoir of pressurized fuel known as a common rail serves as a reservoir for storing a volume of fuel at a suitable injection pressure.

In either of these systems, some of the hydraulically actuated and electrically actuated components can be sensitive to fluid pressure phenomena generated elsewhere in the system. One known common rail fuel system, for instance, is disclosed in United States Patent Application No. 2011/0297125 to Shafer et al.

SUMMARY OF THE INVENTION

In one aspect, a fuel system includes a plurality of fuel injectors, each of the plurality of fuel injectors including an injection control valve assembly and a direct operated nozzle check, and having a high pressure nozzle supply passage and a check control chamber formed therein. The fuel system further includes a common drain conduit fluidly connected to each of the plurality of fuel injectors to receive drained actuating fluid for each of the direct operated nozzle checks. The fuel system still further includes a plurality of isolation valve assemblies each positioned fluidly between the common drain conduit and one of the plurality of fuel injectors. Each of the plurality of isolation valve assemblies includes an isolation valve member movable between a closed position blocking the injection control valve assembly in the one of the plurality of fuel injectors from the common drain conduit, and an open position, and a biaser biasing the isolation valve member toward the closed position.

In another aspect, a fuel injector includes an injector body having a high pressure nozzle supply passage, a check control chamber, and a low pressure outlet formed therein. The fuel injector further includes a direct operated nozzle check, and an injection control valve assembly. The fuel injector still further includes an isolation valve assembly having an isolation valve member movable between a closed position blocking the injection control valve assembly in the one of the plurality of fuel injectors from the common drain conduit, and an open position, and a biaser biasing the isolation valve member toward the closed position.

In still another aspect, an isolation valve assembly for a fuel system includes a valve body positionable in a fuel injector, the valve body having formed therein a low pressure outlet, a drain path structured to fluidly connect to a check control chamber for an outlet check in the fuel injector, and a valve seat positioned fluidly between the drain path and the low pressure outlet. The isolation valve assembly further includes an injection control valve assembly having an injection control valve member movable between a closed control valve position blocking the valve seat, and an open control valve position, and an isolation valve member. The isolation valve member is positioned fluidly between the injection control valve assembly and the low pressure outlet and is movable between an open isolation valve position and a closed isolation valve position. The isolation valve assembly still further includes a biaser biasing the isolation valve member toward the closed isolation valve position, such that movement of the isolation valve member from the closed isolation valve position to the open isolation valve position in response to a pulse of fluid pressure through the valve seat is in opposition to a biasing force of the biaser.

DETAILED DESCRIPTION

Figure 1:
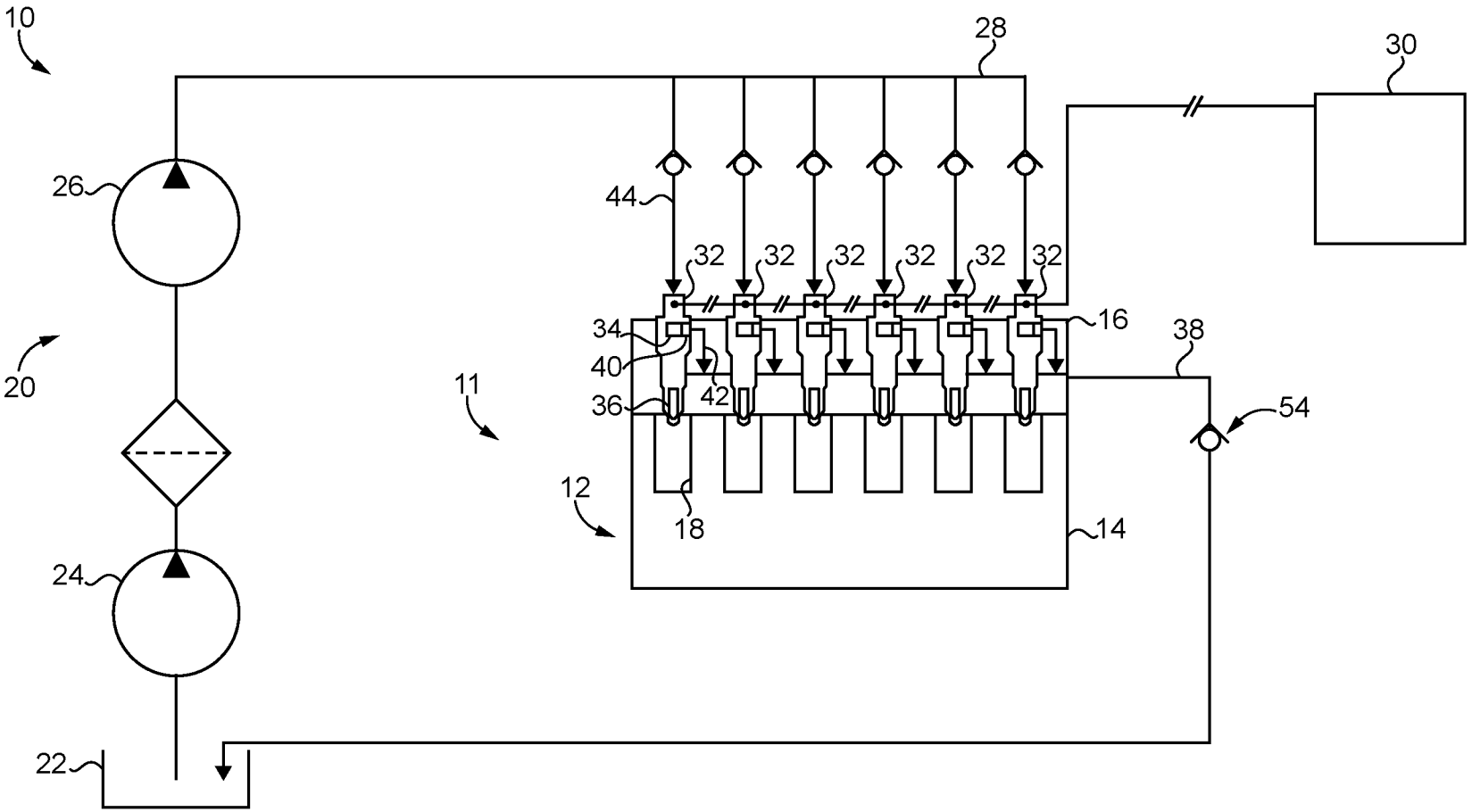
FIG. 1 is a diagrammatic view of an internal combustion engine system, according to one embodiment.

Referring to FIG. 1, there is shown an internal combustion engine system 10 according to one embodiment, and including an internal combustion engine 11 having an engine housing 12 with a cylinder block 14 and an engine head 16. A plurality of combustion cylinders 18 are formed in cylinder block 14, and can include any number of cylinders in any suitable arrangement, such as an in-line arrangement, a V-configuration, or still another. A plurality of pistons (not shown) will be positioned one within each of combustion cylinders 18 and movable between a top dead center position and a bottom dead center position, in a typical four-cycle pattern. Internal combustion engine system 10 further includes a fuel system 20 structured to supply and pressurize a fuel for delivery into combustion cylinders 18. In an implementation, the fuel includes diesel distillate fuel suitable for compression ignition, however, the present disclosure is not thereby limited and other suitable fuels such as biodiesel, blends, et cetera, may be used. A different ignition strategy, such as spark-ignition, or potentially a dual fuel pilot ignition strategy, might be used.

Fuel system 20 includes a fuel supply or fuel tank 22, and equipment for conveying fuel from fuel tank 22 to combustion cylinders 18, including a low pressure transfer pump 24, a high pressure pump 26, and a common rail 28 structured to receive pressurized fuel from high pressure pump 26 and store the pressurized fuel for delivery to a plurality of fuel injectors 32 by way of a plurality of fuel supply lines 44. Fuel supply lines 44 may be formed at least partially within engine head 16 and connected with each of fuel injectors 32 by way of so-called quill connectors or the like, or by way of any other suitable strategy. Fuel system 20 is a common rail fuel system in a practical implementation, however, the present disclosure is not thereby limited and could alternatively include a plurality of unit pumps driven by an engine cam, or by way of hydraulic actuation, and associated with or part of each one of fuel injectors 32. Still other possible configurations might include a number of unit pumps less than the number of fuel injectors, with each individual unit pump serving to pressurize fuel for more than one fuel injector and storing the pressurized fuel in a shared fuel pressure accumulator.

Each of fuel injectors 32 includes an injection control valve assembly 34, and a direct operated nozzle check 36. Injection control valve assembly 34 is electrically actuated, and direct operated nozzle check is hydraulically actuated. An electronic control unit 30 may be in control communication with each injection control valve assembly 34 associated with each of fuel injectors 32.

Fuel system 20 also includes a common drain conduit 38 fluidly connected to each of fuel injectors 32 to receive drained actuating fluid for each of direct operated nozzle checks 36. A drain line 42 may extend between each fuel injector 32 and common drain conduit 38, and may be formed in engine head 16, for example. As shown in FIG. 1 each drain line 42 forms one drain line connection from a respective one of isolation valve assemblies 40 to common drain conduit 38, and a total number of drain line connections in fuel system 20 for draining actuating fluid from the plurality of isolation valve assemblies to common drain conduit 38 is equal to a total number of the plurality of fuel injectors 32 in fuel system 20. A check valve 54 is positioned fluidly between internal combustion engine 11 and fuel tank 22 within common drain conduit 38 to prevent backflow of liquid or gas from fuel tank 22. Fuel injectors 32 may be interchangeable with one another in internal combustion engine system 10. Discussion herein of features or functionality of any one of fuel injectors 32, or discussion of features or functionality of any subpart of one of fuel injectors 32, refers by way of analogy to any other of fuel injectors 32 or subparts thereof. Fuel system 20 further includes a plurality of isolation valve assemblies 40 each positioned fluidly between common drain conduit 38 and one of fuel injectors 32. Each of the plurality of isolation valve assemblies 40 is structured to provide a back pressure in an upstream direction toward the control valve assembly 34 in the associated one of fuel injectors 32 to attenuate or eliminate pulses of fluid pressure produced in response to actuating the corresponding direct operated nozzle check 36, and to block incoming pulses of fluid pressure from other fuel injectors, and thereby limit cross-talk between or among fuel injectors 32 in fuel system 20, as further discussed herein. Fluid connection among fuel injectors 32 upstream of common drain conduit 38 may be unobstructed apart from isolation valve assemblies 40.

Figure 2:
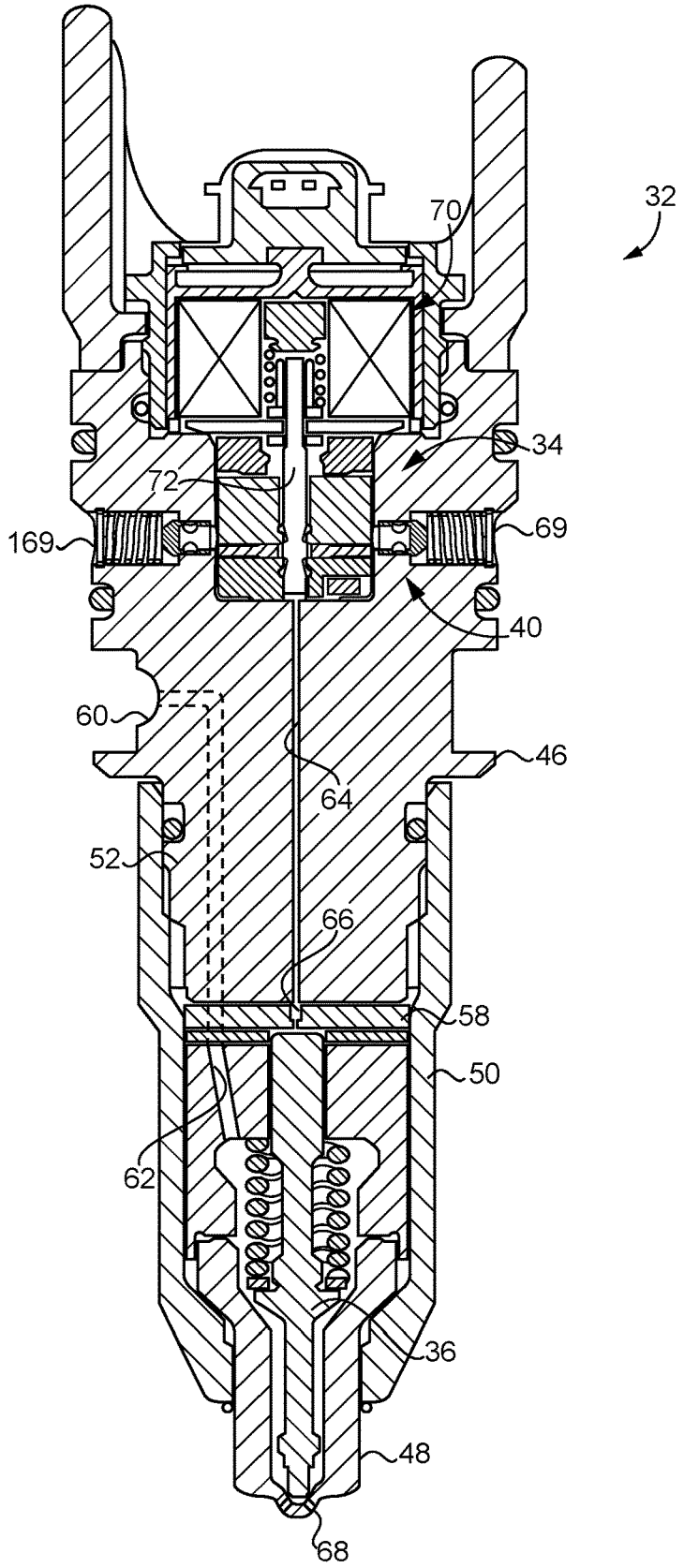
FIG. 2 is a sectioned side diagrammatic view of a fuel injector, according to one embodiment.

Referring also now to FIG. 2, there are shown additional features of fuel injector 32 including an injector body 46. Injector body 46 has a high pressure nozzle supply passage 62, a check control chamber 66, and a low pressure outlet 69 formed therein. Injection control valve assembly 34 is electrically actuated, and direct operated nozzle check 36 is hydraulically actuated as noted above. Injection control valve assembly 34 includes an electrical actuator such as a solenoid 70 that is coupled with electronic control unit 30 in a generally conventional manner. Injector body 46 also has a high pressure inlet 60 and a plurality of spray orifices or nozzle outlets 68 formed therein. Direct operated nozzle check 36 is movable between a closed check position blocking nozzle outlets 68 from high pressure nozzle supply passage 62, and an open check position. High pressure nozzle supply passage 62 is unobstructed from high pressure inlet 60 to nozzle outlets 68 at the open position. A unit pump or spill valve configuration in a fuel injector would likely not be understood to have a high pressure nozzle supply passage unobstructed from a high pressure inlet to a plurality of nozzle outlets in this general manner.

Also in the illustrated embodiment, an orifice plate 58, or potentially a plurality of orifice plates of generally known design, define check control chamber 66. Conveying of high pressure fuel through one or more orifice plates 58 and other internal components of injector body 46, as well as providing low pressure connections is generally performed by way of known configurations of fuel injector componentry. In general terms, actuating injection control valve assembly 34 open enables relieving of a closing hydraulic pressure on a back end of direct operated nozzle check 36, permitting direct operated nozzle check 36 to lift from its closed position to its open position and initiate spraying of pressurized fuel out of nozzle outlets 68. Actuating injection control valve assembly 34 closed enables returning of closing hydraulic pressure to the back end of direct operated nozzle check 36 to end spraying of fuel. Injector body 46 also includes a nozzle piece 48 wherein spray orifices 68 are formed, a casing 50, and a valve body 52. Valve body 52 is part of injector body 46 and can also be understood as part of isolation valve assembly 40.

Figure 3:
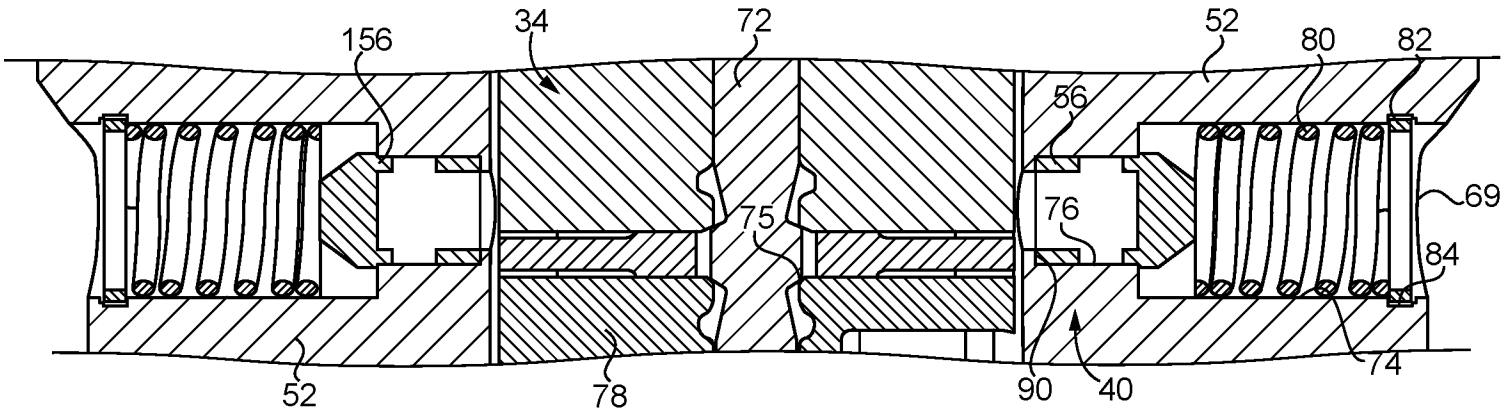
FIG. 3 is a sectioned side diagrammatic view through a portion of the fuel injector of FIG. 2.

Valve body 52 may have low pressure outlet 69 formed therein. Referring also now to FIG. 3, valve body 52 also has a valve seat 75 formed therein. Valve seat 75 is positioned fluidly between check control chamber 66 and low pressure outlet 69. Injection control valve assembly 34 includes a control valve member 72 movable between a closed control valve position blocking valve seat 75, and an open control valve position. In the illustrated embodiment, low pressure outlet 69 is a first outlet to common drain conduit 38, and valve body 52 has formed therein a second outlet 169 to common drain conduit 38. Isolation valve assembly 40 further includes an isolation valve member 56 positioned fluidly between valve seat 75 and low pressure outlet 69. Isolation valve member 56 is movable between a closed isolation valve position blocking injection control valve assembly 34, in the corresponding one of fuel injectors 32, from common drain conduit 38, and an open isolation valve position. Isolation valve assembly 40 may further include a second isolation valve member 156 movable between a closed isolation valve position blocking injection control valve assembly 34 in the corresponding one of fuel injectors 32 from common drain conduit 38, and an open isolation valve position. Second isolation valve member 156 is positioned fluidly between valve seat 75 and second low pressure outlet 169. Injection control valve assembly 34 can also include another orifice plate 78 wherein valve seat 75 is formed. A low pressure drain path 64 is formed in valve body 52 and is connected to check control chamber 66 and extends between check control chamber 66 and injection control valve assembly 34, in particular connecting to valve seat 75. When injection control valve assembly 34 is actuated, such as by energizing or deenergizing electrical actuator 70, to move injection control valve member 72 to open valve seat 75, low pressure is communicated to drain path 64 and check control chamber 66, by way of valve seat 75. When injection control valve 72 returns to block valve seat 75, high pressure is restored.

It has been observed that opening valve seat 75 to enable lifting of direct operated nozzle check 36 can produce a pulse of fluid pressure through valve seat 75. In earlier systems where low pressure outlets of individual fuel injectors could communicate with one another by way of a common drain conduit unobstructed, these pulses of fluid pressure were observed to potentially cause problematic cross-talk, such as by popping open an injection control valve in one fuel injector in response to a pulse of fluid pressure, or multiple pulses of fluid pressure, produced by one or more of the other fuel injectors. As will be further apparent by way of the following description, isolation valve assembly 40 is structured to reduce or eliminate such cross-talk or other phenomena leading to performance degradation in a fuel system.

Figure 4:
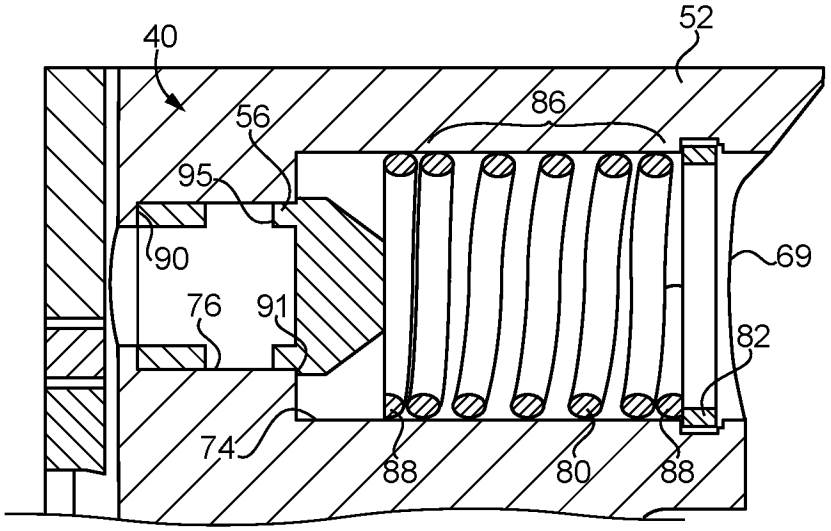
FIG. 4 is a sectioned side diagrammatic view through a portion of the fuel injector of FIG. 2 showing an isolation valve assembly in a first configuration.
Figure 5:
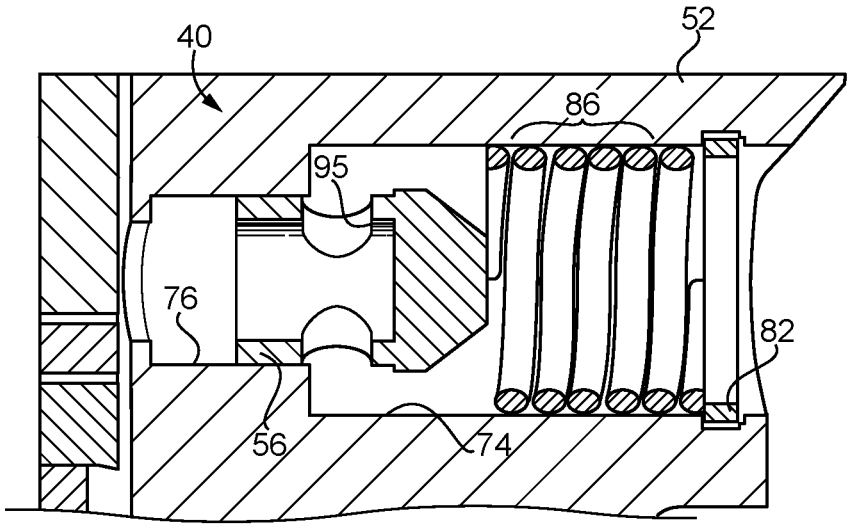
FIG. 5 is a sectioned side diagrammatic view similar to FIG. 4, showing the isolation valve assembly in a second configuration.
Figure 6:
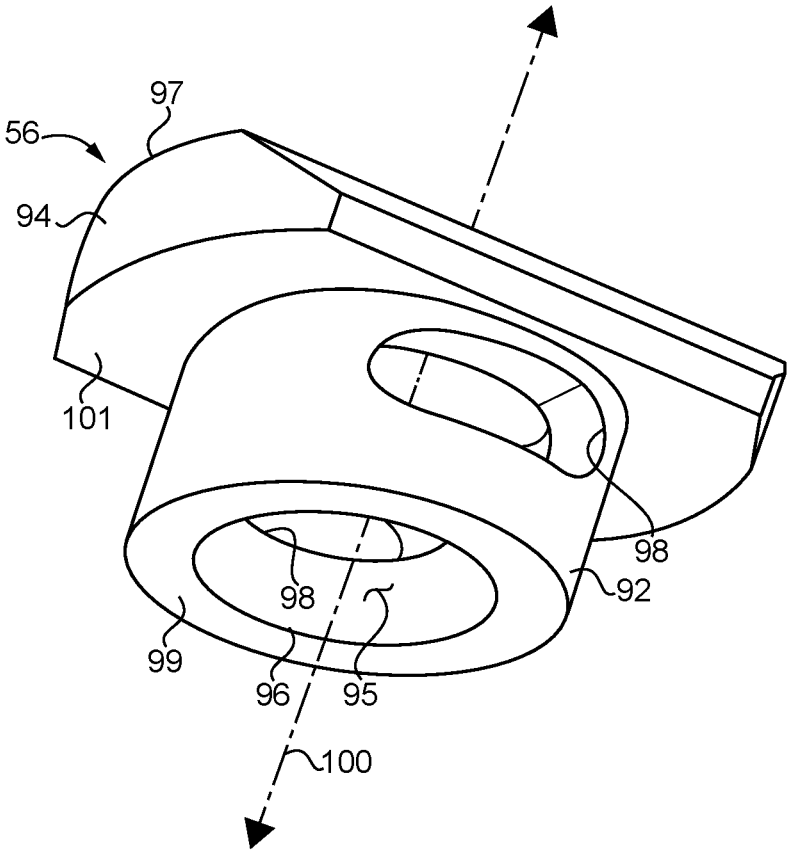
FIG. 6 is a perspective view of an isolation valve member, according to one embodiment.

It will be recalled that each of a plurality of isolation valve assemblies 40 in fuel system 20 includes an isolation valve member 56 movable between a closed isolation valve position blocking the corresponding injection control valve assembly 34 from common drain conduit 38, and an open isolation valve position. Isolation valve assembly 40 further includes a biaser 80 biasing isolation valve member 56 toward the closed position. Isolation valve member 156 may be associated similarly with a biaser (not numbered), and may otherwise be structured substantially identically to isolation valve member 56 and associated components. Referring also now to FIG. 4, there are shown additional features of isolation valve assembly 40 in greater detail. Valve body 52 further has a bore 74 formed therein extending between valve seat 75 and low pressure outlet 69, and a counterbore 76 connecting with bore 74 and receiving isolation valve member 56 therein. In the illustrated embodiment, biaser 80 includes a biasing spring, and fuel injector 32 and isolation valve assembly 40 further include a snap ring 82 within valve body 52. Snap ring 82 is fitted within a groove 84 formed in bore 74, such that biaser 80 is trapped between isolation valve member 56 and snap ring 82. Referring also to FIG. 5 and FIG. 6, isolation valve member 56 includes a stem 92 and a valve head 94. Stem 92 is within counterbore 76 at each of the closed position and the open position of isolation valve member 56. It can also be noted that isolation valve member 56 has an outlet passage 95 formed in stem 92. FIG. 4 depicts isolation valve member 56 at the closed isolation valve position, whereas FIG. 5 depicts isolation valve member 56 at the open isolation valve position. Outlet passage 95 is fluidly connected to low pressure outlet 69 at the open isolation valve position.

As shown in FIG. 6 isolation valve member 56 defines a longitudinal axis 100 extending between a first axial end surface 97 formed on valve head 94 and a second axial end surface 99 formed on stem 92. Isolation valve assembly 40 may be configured such that first axial end surface 97 contacts biaser 80. A downstream side of valve head 94 is oriented toward low pressure outlet 69, and an upstream side is oriented toward injection control valve assembly 34. Biaser 80 may further include an underhead surface 101. When isolation valve member 56 is at the closed position outlet passage 95 is blocked from fluid communication with bore 74. Underhead surface 101 may contact a wall surface 91 to provide fluid sealing, or substantial fluid sealing. Second axial end surface 99 may approach, or in some instances could contact depending upon the design, another wall surface 90 at an and of counterbore 76. Also shown in FIG. 6 is an inlet 96 to outlet passage 95, and a plurality of outlets 98 each formed in stem 92. It can thus be noted that in the configuration shown in FIG. 4 outlets 98 are within counterbore 76, and when isolation valve member 56 moves to an open position, with stem 92 still within counterbore 76, fluid communication is established between outlets 98 and bore 74, and thus low pressure outlet 69.

INDUSTRIAL APPLICABILITY

As discussed herein, isolation valve assembly 40 may be normally closed to block fluid communication between the associated fuel injector 32, and injection control valve assembly 34 in particular, and common drain conduit 38 and other fuel injections and thereby prevent fluid pressure pulses from being communicated between fuel injectors 32, and cause injection control valve assembly 34 to pop open or cause other problems potentially leading to performance degradation or requiring changes to control methodology or electronic trimming. In one implementation, it may be desirable for isolation valve assembly 40 to produce a back pressure of approximately 550 kiloPascals (kPa), although depending upon fuel system design a different back pressure might be desired.

As can be seen comparing FIG. 4 with FIG. 5, isolation valve member 56 can move from its closed position to an open position in response to a pulse of fluid pressure that is produced by opening injection control valve assembly 34 and lifting nozzle outlet check 36, such that the pulse of fluid pressure and actuating fluid can be drained to common drain conduit 38, but inhibiting incoming pulses of fluid pressure or other fluid pressure excursions. Biaser 80 may be configured with a plurality of active coils 86 advancing and extending between inactive end coils 88 which contact valve head 94 and snap ring 82. In a first compressed state, for instance as depicted in FIG. 4, active coils 86 are separated slightly from one another. In a second compressed state, approximately as depicted in FIG. 5, active coils 86 may contact one another as biaser 80 bottoms out at its open position. In other embodiments a coil spring or the like held in a tensioned state might be used, or another biasing strategy altogether. When the pulse of fluid pressure has passed and actuating fluid has drained from isolation valve assembly 40 toward common drain conduit 38, isolation valve member 56 may return from its open isolation valve position to its closed isolation valve position, restoring fluid sealing or substantially fluid sealing, between injection control valve assembly 34 and low pressure outlet 69. It is contemplated that isolation valve member 56 and isolation valve member 156 can function in parallel with one another and have substantially identical design and functionality. In other instances, two different isolation valve members having slightly different functionality might be used. Moreover, while in a practical implementation strategy isolation valve assembly 40 is resident in fuel injector 32, in other instances fuel system 20 could be configured with isolation valve assembly 40 positioned outside of injector body 46 and fluidly between fuel injector 32 and common drain conduit 28.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A fuel system comprising:

a plurality of fuel injectors, each of the plurality of fuel injectors including an injection control valve assembly and a direct operated nozzle check, and having a high pressure nozzle supply passage, a first low pressure outlet, a second low pressure outlet, and a check control chamber formed therein;

a common drain conduit fluidly connected to each of the plurality of fuel injectors to receive drained actuating fluid for each of the direct operated nozzle checks;

a plurality of isolation valve assemblies and a plurality of drain lines, each of the plurality of isolation valve assemblies being positioned fluidly between the injection control valve assembly of one of the plurality of fuel injectors and one of the plurality of drain lines;

the plurality of drain lines each forming one drain line connection to the common drain conduit for draining actuating fluid from the one of the plurality of isolation valve assemblies, and a total number of drain line connections in the fuel system for draining actuating fluid from the plurality of isolation valve assemblies to the common drain conduit is equal to a total number of the plurality of fuel injectors in the fuel system;

each of the plurality of isolation valve assemblies including a first isolation valve member movable between a closed position blocking the injection control valve assembly in the respective one of the plurality of fuel injectors from the corresponding first low pressure outlet, and an open position, and a first spring biaser biasing the isolation valve member toward the closed position;

each of the plurality of isolation valve assemblies includes a second isolation valve member movable between a closed position blocking the injection control valve assembly in the respective one of the plurality of fuel injectors from the corresponding second low pressure outlet, and an open position, and a second spring biaser biasing the second isolation valve member toward the closed position; and each of the plurality of isolation valve assemblies is resident in the respective one of the plurality of fuel injectors.

2. The fuel system of claim 1 wherein each of the plurality of isolation valve assemblies includes a valve body having formed therein a first outlet fluidly connected to the common drain conduit and a second outlet fluidly connected to the common drain conduit.

3. The fuel system of claim 2 wherein in each respective one of the plurality of fuel injectors:

a valve seat is positioned fluidly between the check control chamber and each of the first outlet and the second outlet;

the injection control valve assembly includes a control valve member movable between a closed control valve position blocking the valve seat, and an open control valve position; and the first isolation valve member is positioned fluidly between the valve seat and the first outlet, and the second isolation valve member is positioned fluidly between the valve seat and the second outlet.

4. The fuel system of claim 1 wherein:

each of the plurality of isolation valve assemblies further includes a first snap ring and a second snap ring within the corresponding one of the plurality of fuel injectors; and the first spring biaser includes a first biasing spring held in compression between the first snap ring and the first isolation valve member and the second spring biaser includes a second biasing spring held in compression between the second snap ring and the second isolation valve member.

5. The fuel system of claim 1 wherein each of the first isolation valve member and the second isolation valve member includes a stem, a head attached to the stem, and an outlet passage extending through the stem and in fluid communication with the common drain conduit at the open position of the respective isolation valve member.

6. The fuel system of claim 5 wherein each of the plurality of fuel injectors includes a high pressure inlet, and further comprising a common rail in fluid communication with the high pressure inlet of each of the plurality of fuel injectors.

7. A fuel injector comprising:

an injector body having a high pressure nozzle supply passage, a check control chamber, and a valve body having a first low pressure outlet and a second low pressure outlet formed therein;

a direct operated nozzle check;

an injection control valve assembly; and an isolation valve assembly including a first isolation valve member movable between a closed position fluidly isolating the injection control valve assembly from the first low pressure outlet, and an open position, a first spring biaser biasing the first isolation valve member toward the closed position, and a first snap ring supported in the valve body, and the first spring biaser is trapped between the first snap ring and the first isolation valve member;

the isolation valve assembly further including a second isolation valve member movable between a closed position fluidly isolating the injection control valve assembly from the second low pressure outlet, and an open position, and a second spring biaser biasing the second isolation valve member toward the closed position, and a second snap ring supported in the valve body, and the second spring biaser is trapped between the second snap ring and the second isolation valve member; and each of the first isolation valve member and the second isolation valve member defining a longitudinal axis and including a valve head having an axial end surface in contact with the respective spring biaser, an underhead surface, and a valve stem extending from the underhead surface, and the underhead surface is in contact with the injector body at the respective closed position.

8. The fuel injector of claim 7 wherein the injector body has a valve seat formed therein, and wherein each of the first isolation valve member and the second isolation valve member is positioned fluidly between the valve seat and the respective one of the first low pressure outlet and the second low pressure outlet.

9. The fuel injector of claim 8 wherein:

the valve body has a first bore formed therein extending between the valve seat and the first low pressure outlet, and a second bore larger than the first bore connecting with the first bore and receiving the first isolation valve member therein; and the valve body further has a third bore formed therein extending between the valve seat and the second low pressure outlet, and a fourth bore larger than the third bore and receiving the second isolation valve member therein.

10. The fuel injector of claim 9 wherein the stem of the first isolation valve member is within the second bore at each of the respective closed position and open position, and the stem of the second isolation valve member is within the fourth bore at each of the respective closed position and open position.

11. The fuel injector of claim 10 wherein the first isolation valve member has an outlet passage formed in the stem, and the outlet passage is fluidly connected to the low pressure outlet at the open position of the first isolation valve member.

12. The fuel injector of claim 10 wherein the valve head of the first isolation valve member includes a downstream side oriented toward the first low pressure outlet, and an upstream side, and wherein the first spring biaser includes a biasing spring in contact with the downstream side of the valve head of the first isolation valve member.

13. The fuel injector of claim 7 wherein the injector body has a high pressure inlet and a plurality of nozzle outlets formed therein, and wherein the direct operated nozzle check is movable between a closed check position blocking the plurality of nozzle outlets from the high pressure nozzle supply passage, and an open check position, and the high pressure nozzle supply passage is unobstructed from the high pressure inlet to the plurality of nozzle outlets at the open check position.

14. The fuel injector of claim 13 wherein the first isolation valve member is movable from the closed position to the open position in response to a pulse of fluid pressure through a valve seat in the fuel injector, in opposition to a biasing force of the first spring biaser.

15. An isolation valve assembly for a fuel system comprising:

a valve body positionable in a fuel injector, the valve body having formed therein a first low pressure outlet, a second low pressure outlet, and a drain path structured to fluidly connect to a check control chamber for an outlet check in the fuel injector;

a plate supported in the valve body and including a valve seat positioned fluidly between the drain path and each of the first low pressure outlet and the second low pressure outlet;

an injection control valve assembly including an injection control valve member movable between a closed control valve position blocking the valve seat, and an open control valve position;

a first isolation valve member positioned fluidly between the injection control valve assembly and the first low pressure outlet and movable between an open isolation valve position and a closed isolation valve position, and the first isolation valve member having a valve head in fluid sealing contact with the valve body fluidly isolating the injection control valve assembly from the first low pressure outlet at the closed isolation valve position;

a first spring biaser biasing the first isolation valve member toward the closed isolation valve position, such that movement of the first isolation valve member from the closed isolation valve position to the open isolation valve position in response to a pulse of fluid pressure through the valve seat is in opposition to a biasing force of the first spring biaser;

a second isolation valve member positioned fluidly between the injection control valve assembly and the second low pressure outlet and movable between an open isolation valve position and a closed isolation valve position, and the second isolation valve member having a valve head in fluid sealing contact with the valve body fluidly isolating the injection control valve assembly from the second low pressure outlet at the closed isolation valve position;

a second spring biaser biasing the second isolation valve member toward the closed isolation valve position, such that movement of the second isolation valve member from the closed isolation valve position to the open isolation valve position in response a pulse of fluid pressure through the valve seat is in opposition to a biasing force of the second spring biaser; and each of the first isolation valve member and the second isolation valve member defining a longitudinal axis and including upon the respective valve head an axial end surface in contact with the respective spring biaser, an underhead surface, and a valve stem extending from the underhead surface, and the underhead surface is in contact with the valve body at the respective closed isolation valve position.

16. The isolation valve assembly of claim 15 wherein:

the valve body has a first bore formed therein extending between the valve seat and the low pressure outlet, and a second bore larger than the first bore connecting with the first bore and receiving the first isolation valve member therein; and the first isolation valve member includes a stem, and the stem is within the second bore at each of the closed isolation valve position and the open isolation valve position.

* * * * *